United States Patent [19]

Mönch et al.

[11] 4,416,712

[45] Nov. 22, 1983

[54] DOUBLE-BASE SOLID PROPELLANTS

[75] Inventors: Joachim Mönch, Neunkirchen; Heinrich Brachert, Troisdorf-Oberlar, both of Fed. Rep. of Germany

[73] Assignee: Dynamit Nobel AG, Troisdorf, Fed. Rep. of Germany

[21] Appl. No.: 360,963

[22] Filed: Mar. 23, 1982

[30] Foreign Application Priority Data

Apr. 1, 1981 [DE] Fed. Rep. of Germany ..... 3113010

[51] Int. Cl.[3] ..... C06B 25/26

[52] U.S. Cl. ..... 149/98; 149/92; 149/93

[58] Field of Search ..... 149/98, 92, 93

[56] References Cited

U.S. PATENT DOCUMENTS 3,951,706 4/1976 Eldridge ..... 149/98 X

*Primary Examiner*—Stephen J. Lechert, Jr.
*Attorney, Agent, or Firm*—Felfe & Lynch

[57] ABSTRACT

The present invention relates to double-base solid propellant mixtures whose burning characteristic is regulated by the addition of certain moderators such that the burn rates obtained are achieved independently of the temperature and pressure during the burn. This regulation is accomplished by the addition of a mixture of carbon black and cellulose acetate. The weight ratio of carbon black to cellulose acetate in this mixture is between 1:0.5 and 1:10. Depending on the composition of the solid propellant, the combustion of the rocket fuel can be regulated by regulating this mixture within the stated limits such that it takes place independently of temperature and pressure. The amount of the carbon black and cellulose acetate mixture present in the fuel can vary between 0.2 and 6% by weight; the carbon black is contained in the propellants of the invention in amounts between 0.05 and 1.0% by weight. The charges contain as the energy-supplying component a mixture of cellulose nitrate and nitroglycerin, as well as known additives to facilitate working and increase the rate of burn. The effect in accordance with the invention is found also in those propellant charges which additionally contain as energy-supplying component still other known, high-energy substances.

5 Claims, 9 Drawing Figures

DOUBLE-BASE SOLID PROPELLANTS

Figure 1:
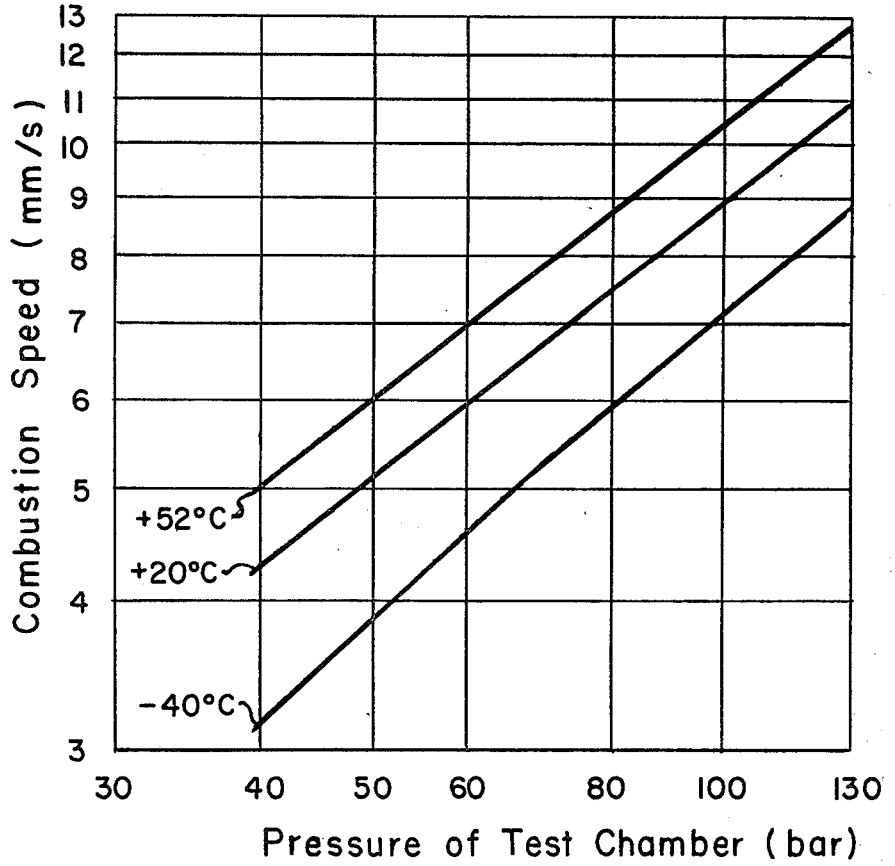

This invention relates to double-base solid propellants having improved burning characteristics. More particularly, the present invention is directed to double-base solid propellants based nitrocellulose and nitroglycerin, plasticizers and burning moderators, which are prepared by the pressing method. They are used in propellant charges for rocket motors or for other devices which are driven by combustion gases.

It is known to influence the burning of solid propellants by the addition of burning moderators. This is necessary because the burning of the fuels without the addition of moderators is irregular and greatly dependent upon the pressure and temperature in the combustion chamber.

The burning behavior of a propellant can be determined by measuring the rate of burning. The term, "rate of burning", refers to the distance traveled by the flame front per unit of time perpendicular to the free surface of the propellant charge. Without the addition of burning moderators, the rate of burning depends both on the temperature and on the pressure in the combustion chamber. The burning moderators known heretofore merely bring about a modification of the burn with regard to the pressure, so that the burn is virtually constant over a particular pressure range. Constancy of temperature has not yet been obtained by means of these known burning moderators.

The problem therefore existed of finding solid propellants whose burning takes place largely independently of the prevailing temperature, while at the same time, however, the freedom from dependence on pressure that has been attainable heretofore is to be preserved, and also no solid particles which cause smoke or fog are to occur in the combustion gases.

THE INVENTION

As a solution to this problem it has been found that the addition of cellulose acetate to double-base solid propellants brings about an increase in the rate of burning of these propellants at low temperatures. Surprisingly, this increase obtained in the rate of burning by the addition of cellulose acetate is disproportionately greater in the low temperature range than in the medium and upper temperature range. It is achieved by the addition of as little as between 0.1 and 5% with respect to the weight of the entire charge of fuel.

In solving the above-stated problem it has furthermore been found that, by the simultaneous addition of carbon black and cellulose acetate to the solid propellants, the rate of burning can be regulated such that it is independent of pressure and temperature within a particular range of pressures.

Accordingly, the subject matter of the present invention is double-base solid propellants which are based on a mixture of nitrocellulose and nitroglycerin, and plasticizers, burning moderators and stabilizers, which are characterized in that they additionally contain a mixture of cellulose acetate and carbon black in amounts between 0.2 to 6 weight-percent with respect to the total weight of the solid rocket fuel.

A substantial temperature and pressure constancy in the burn can be achieved when the weight ratio of carbon black and cellulose acetate is between 1:0.5 and 1:10, preferably between 1:2 and 1:5. The most favorable ratio of cellulose acetate to carbon black depends on the amount of carbon black which is contained in the propellant charge.

In accordance with the invention, the carbon black content in the charges of the invention is between 0.05 and 1.0 weight-percent with respect to the entire fuel, preferably between 0.1 and 0.4 weight-percent. Accordingly, the amount of cellulose acetate in the rocket fuels of the invention is between 0.1 and 5 weight-percent, preferably between 0.2 and 2.0 weight-percent.

The addition of carbon black and cellulose acetate to double-base propellant charges, in accordance with the invention, thus make it possible to regulate the burning of the propellant charges such that it takes place largely independently of temperature and pressure. The precise ratio of carbon black to cellulose acetate depends, of course, on the composition of the rocket fuel and on the desired rate of burning. However, it can easily be determined by means of brief, orientational preliminary experiments.

It is already known that the addition of carbon black alone to double-base propellant charges results in an increase in the burning rate. The increase, however, is virtually the same in all temperature ranges, so that such addition has not made it possible to make the burning rate independent of temperature. The combination of carbon black and cellulose acetate in accordance with the invention for the first time makes possible a temperature-dependent inversion of the burning, so that burning will take place uniformly over a broad range of temperatures.

Propellant charges whose burning can be regulated in accordance with the invention independently of pressure and temperature include those known as "double-base propellant charges". In these charges the energy providing component consists of a mixture of cellulose nitrate with a nitrogen content between 11 and 13.4%, preferably 12 to 13% N, (generally known as nitrocellulose) and glycerin trinitrate (generally called nitroglycerin). Furthermore, these known double-base fuels also contain stabilizers for these energy supplying components, plasticizers to improve the working of the charge in the screw mixing units and already-known burning moderators such as PbO or organic lead and copper compounds. The amount of these working adjuvants and burning moderators is generally less than 15% of the total weight of the charge.

The effect produced by the invention is apparent also in those double-base propellant charges which, in addition to the mixture of nitrocellulose and nitroglycerin, contain still other solid, highly energy-righ explosives such as, for example, pentaerythrite tetranitrate or cyclic nitramines such as cyclotrimethylene trinitramine.

The propellant charges of the invention ae prepared in a manner known in itself. It is desirable to mix a prepared mixture of nitrocellulose and nitroglycerin containing about 20% water for safety, in a uniform manner with the other components in suitable mixing machines. Then granulation is performed, followed by drying at temperatures around 60° C. in a blast of hot air. The granules are then subjected, if desired, to an additional forming process.

EXAMPLES

EXAMPLE 1

(First Example for Purposes of Comparison)

In this example, a propellant charge is treated without the addition of burning moderators. It has the following composition:

50.4% nitrocellulose (12.6% nitrogen)
38.1% nitroglycerin
6.1% diethyldiphenylurea
5.1% ethylphenylurethane
0.3% wax.

A prepared mixture of nitrocellulose and nitroglycerin containing also about 20 weight-percent of water was mixed together uniformly with the rest of components in a Werner & Pfleiderer kneader for at least one hour. The mass was then passed three times through a disk kneader. Then the material was twice granulated in a granulating screw press, and the granules were than dried in a hot air current at 60° C. for 12 to 15 hours. The granules thus treated were extruded in a dual screw extrusion press to a material in strand form. After appropriate preparation, this material was used for forming rods for determining the burning rate by the method of Crawford. The results of the test are represented in the appended FIG. 1.

This figure shows that, without the addition of burning moderators, the graph of the burning speed shows a steady rise. These characteristics are accordingly dependent upon temperature and pressure.

EXAMPLE 2

(Second Example for Purposes of Comparison)

A propellant charge composition was prepared containing a known burn moderator. The charge had the following composition:

48.8% nitrocellulose (12.6% nitrogen)
36.9% nitroglycerin
6.0% diethyldiphenylurea
5.0% ethylphenylurethane
3.0% lead-2-ethylhexoate
0.3% wax.

Figure 2:
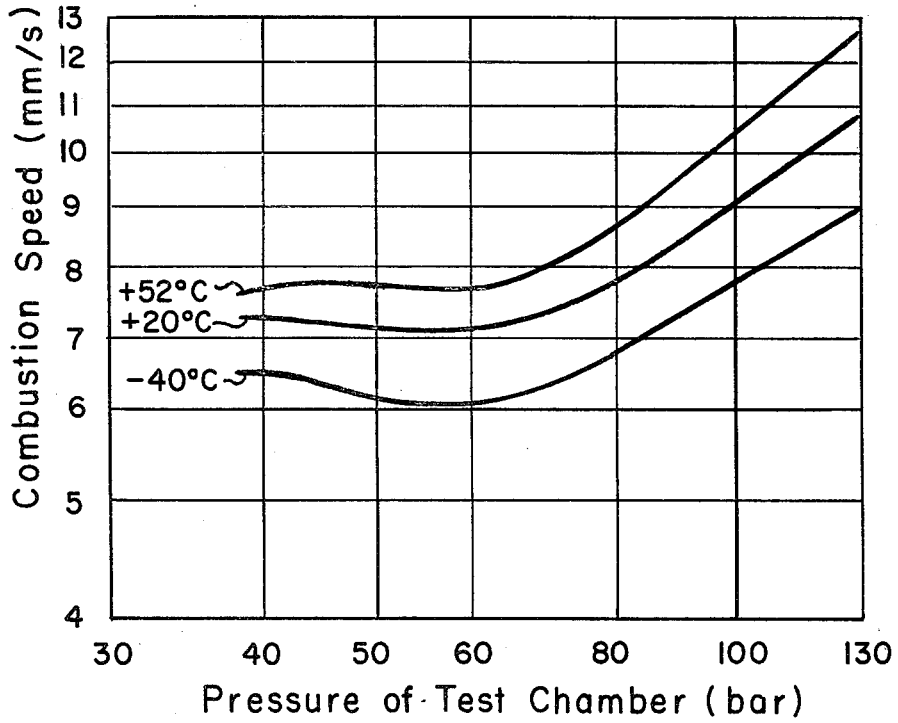

The propellant was made in the same manner as in Example 1. The results of the tests for burning speed are represented in FIG. 2. This illustration shows that, by the addition of these known burn moderators, the combustion is affected such that an increase of the burning rate takes place in the lower pressure range. Depending on the nature and amount of the moderator employed, this results in the establishment of a plateau burn or (if larger proportions of the regulator are used) a mesa burn. The relationship to temperature, however, remains the same. This is apparent from the distance between the individual combustion curves at different temperatures.

EXAMPLE 3

(Third Example for Purposes of Comparison)

Figure 3:
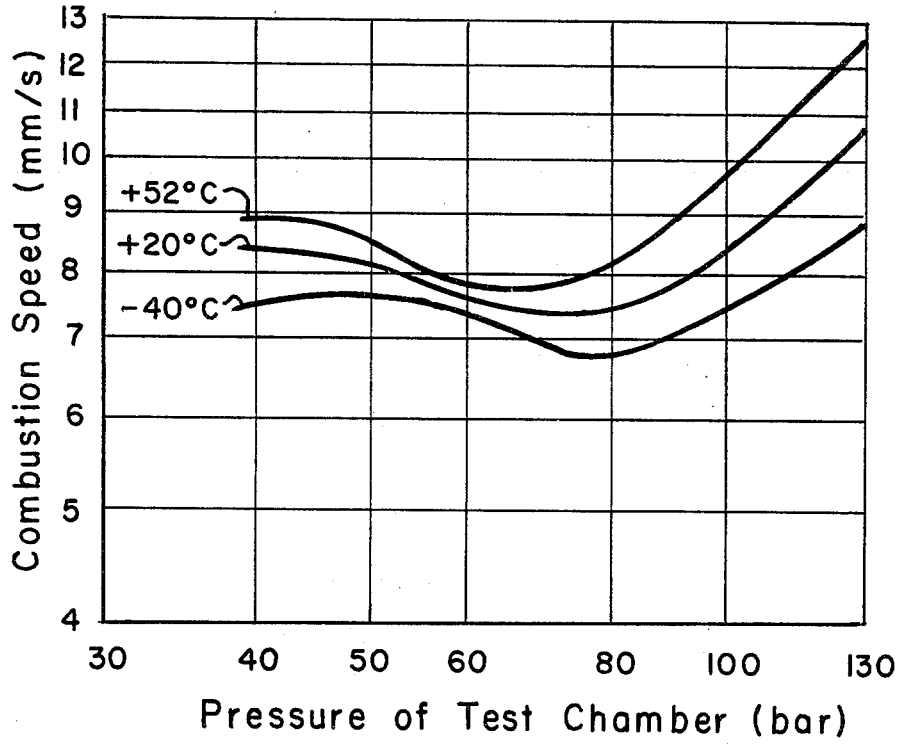

A propellant charge was prepared in which several known combustion moderators were combined. The preparation was performed as in Example 1. The results of the determination of the burning rates are to be seen in FIG. 3. Here again the relationship between the burning rate and the temperature is evident, although over a short pressure range the curves as seen to come closer together. This is purely coincidental, however, and is in no way controllable.

The composition of the propellant charge was as follows:

48.6% nitrocellulose (12.6% nitrogen)
36.8% nitroglycerin
6.0% diethyldiphenylurea
5.0% ethylphenylurethane
2.0% lead-2-ethylhexoate
0.4% lead salicylate
0.9% lead(II) oxide
0.3% wax.

EXAMPLE 4

(Fourth Example for Purposes of Comparison)

Figure 4:
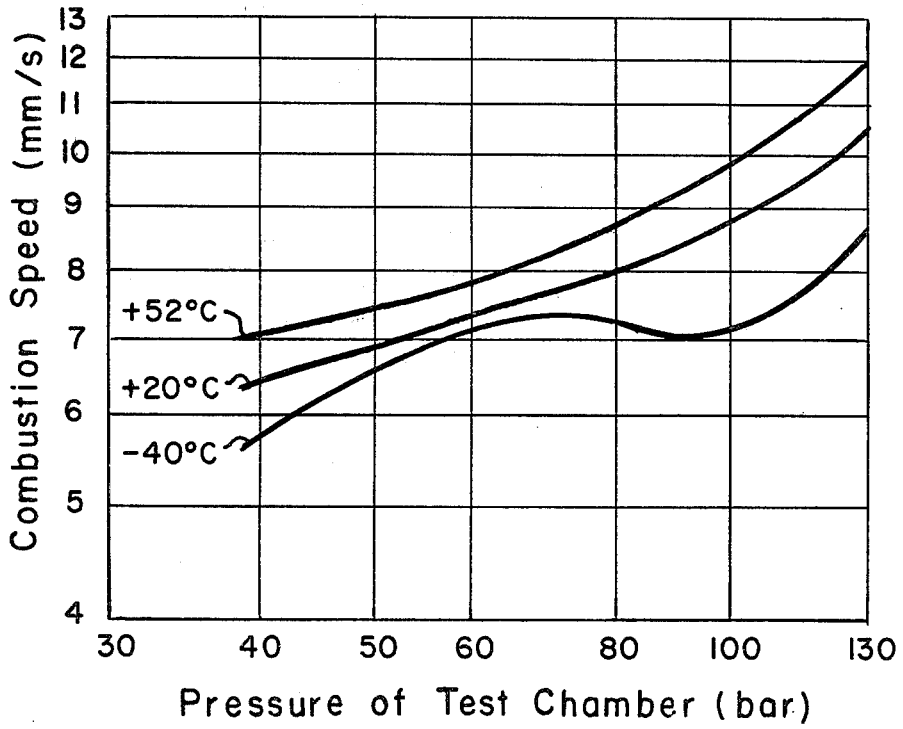

This example shows that the temperature dependence cannot be changed by the addition of carbon black. The preparation and evaluation of the propellant was performed in the same manner as in Examples 1 to 3. The propellant had the following composition:

49.3% nitrocellulose (12.6% nitrogen)
37.2% nitroglycerin
6.0% diethyldiphenylurea
5.0% ethylphenylurethane
2.0% lead-2-ethylhexoate
0.2% carbon black (Durex O, a commercial product made by Degussa of Frankfurt)
0.3% wax FIG. 4 shows the burning curves of this propellant.

EXAMPLE 5

(According to the Invention)

As in Example 1, a propellant charge of the following composition was prepared:

48.2% nitrocellulose (12.6% nitrogen)
37.1% nitroglycerin
6.0% diethyldiphenylurea
5.0% ethylphenylurethane
2.0% lead-2-ethylhexoate
1.2% cellulose acetate (Cellit L 900, a commercial product of Bayer AG, Leverkusen)
0.2% carbon black (Durex O, a commercial product of Degussa, Frankfurt)
0.3% wax.

Figure 5:
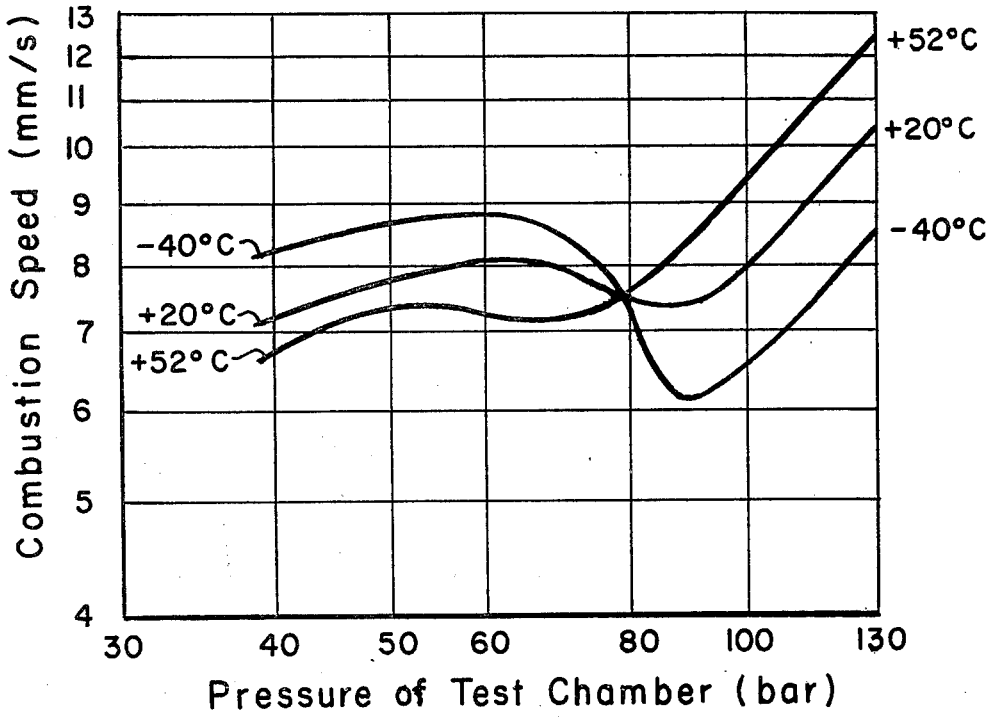

The evaluation of the propellant charge was performed as in Examples 1 to 4. The behavior of this fuel can be seen in FIG. 5. The burn curves show that, at low temperatures, due to the addition of cellulose acetate, the burning rate increases overproportionately, so that an inversion of the burn characteristics occurs.

EXAMPLE 6

(According to the Invention)

A propellant of the same composition as in Example 5 was prepared, except that the amount of cellulose acetate was slightly reduced. The composition had a content of only 1.0% cellulose acetate, so that the ratio of cellulose acetate to carbon black was 5:1.

Figure 6:
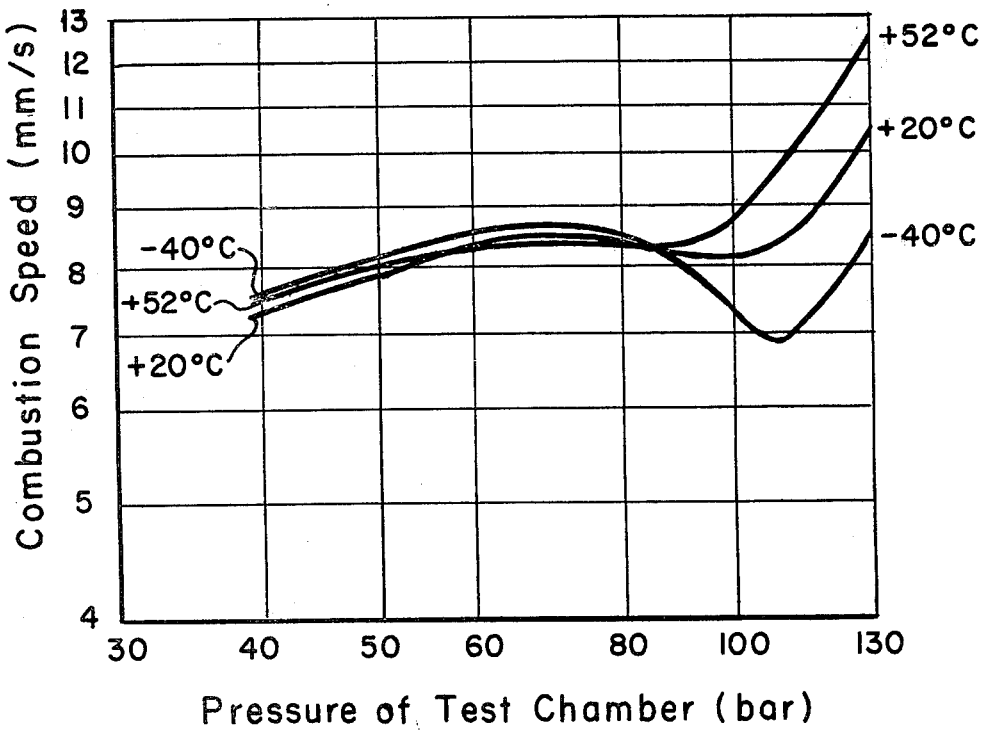

The results of the burning rate testing are represented in FIG. 6; the figure shows that the burn curves are quite close together, and throughout this pressure range scarcely any change occurs in the burning rate.

EXAMPLE 7

(According to the Invention)

Figure 7:
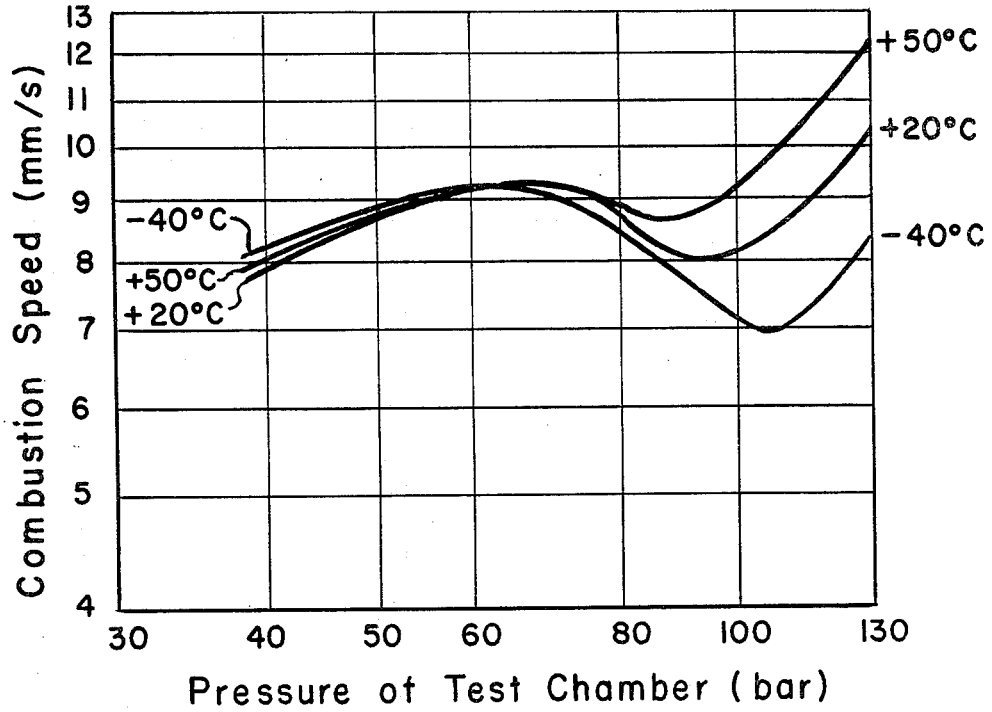

This example shows that the action in accordance with the invention, of the mixture of cellulose acetate and carbon black occurs independently of the other burn moderators present in the mixture. The same composition as in Example 6 was selected, with the difference that lead stearate was taken instead of lead-2-ethylhexoate. The working up and testing were performed as in Example 6. The results of the burning rate tests are represented in FIG. 7.

EXAMPLE 8

A propellant of the following composition was prepared in the same manner as in the preceding examples:

44.9% nitrocellulose (12.6% nitrogen)
32.3% nitroglycerin
5.0% pentaerythrite tetranitrate
12.9% glycerin triacetate
1.0% diethyldiphenylurea
1.0% nitrodiphenylamine
1.0% lead(II) oxide
1.0% copper(II) oxide
0.5% cellulose acetate (as in Example 5)
0.3% carbon black (as in Example 5)
0.2% wax.

Figure 8:
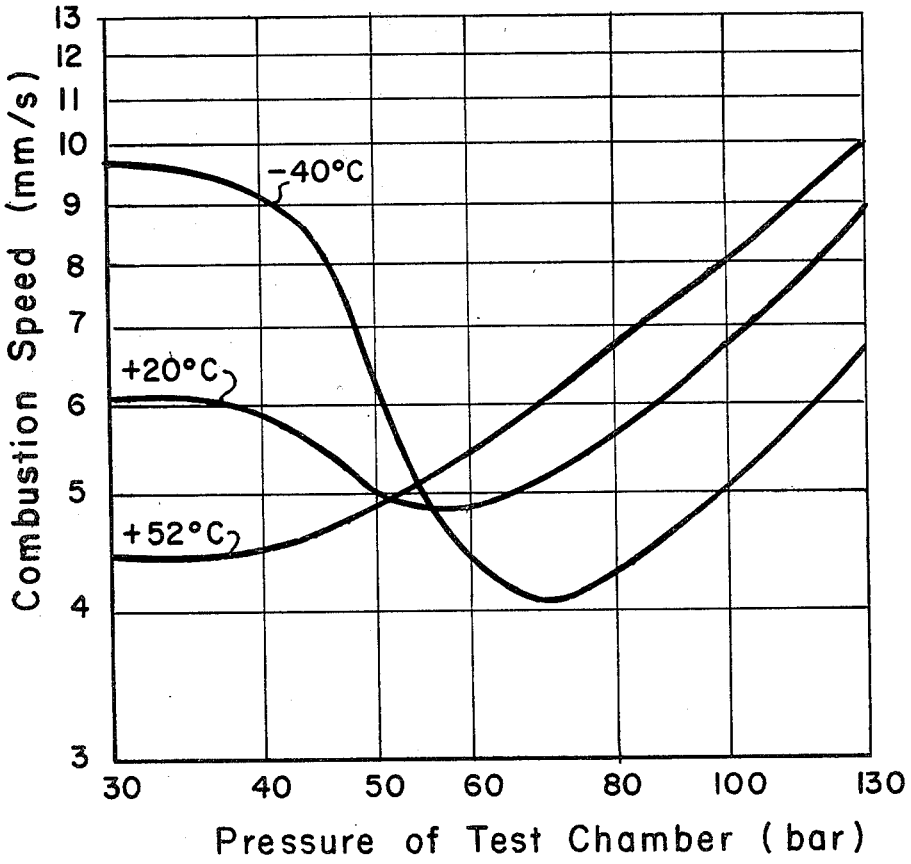

The results of the burning rate tests are given in FIG. 8. This figure again shows that, even in the presence of additional high-brisance explosives and other stabilizers than in the preceding examples, the addition of cellulose acetate brings about an increase in the burning rate in the lower temperature range. In this example the ratio of carbon black to cellulose acetate was deliberately selected so as to produce an overcontrol.

EXAMPLE 9

Figure 9:
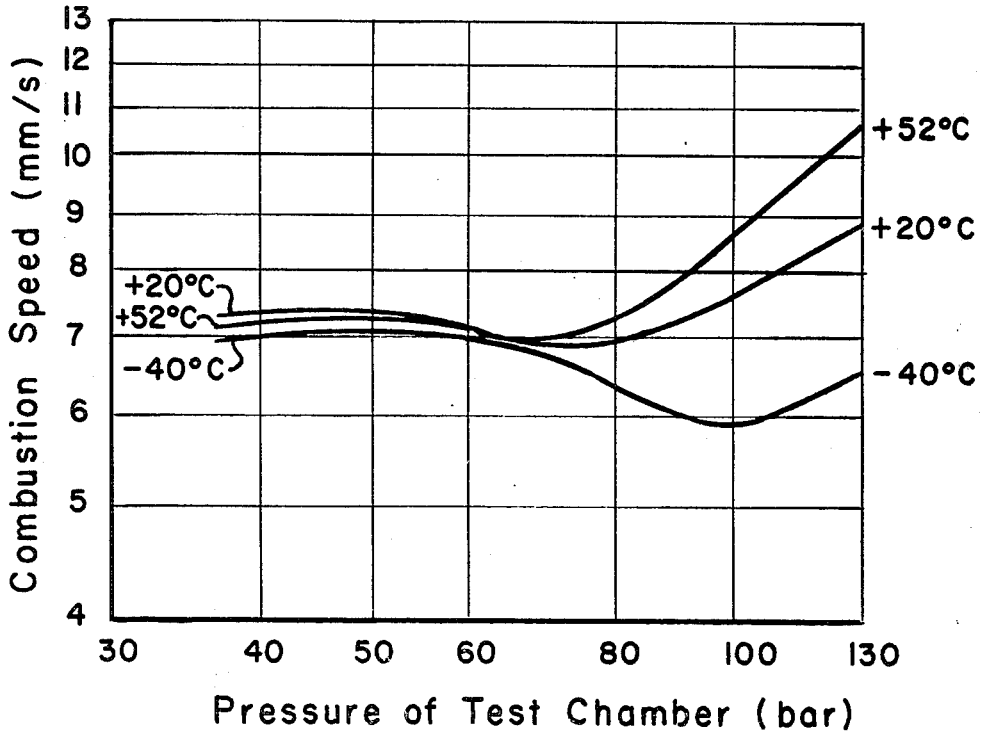

A propellant of the same composition as in Example 8 was prepared, except that the cellulose acetate content was 0.3 wt.-% and that of the carbon black was 0.15 wt.-%; the content of nitrocellulose and nitroglycerin was accordingly increased. The preparation of this propellant and its working up were performed in the same manner as in Example 8. The results of the burning rate tests are represented in FIG. 9. The curves obtained show that the burning rates are independent both of temperature and of pressure over a wide range of pressures.

It will be understood that the specification and examples are illustrative but not limitative of the present invention and that other embodiments within the spirit and scope of the invention will suggest themselves to those skilled in the art.

What is claimed is:

1. Double-base solid propellant composed of at least 85% by weight of a mixture of nitrocellulose and nitroglycerin, and containing, additionally, a mixture in a ratio of 1:0.5 to 1:10, of carbon black and cellulose acetate, in an amount of 0.2 to 6 wt.-%, based on the total weight of the solid propellant.

2. Double-base solid propellant as claimed in claim 1, comprising nitrocellulose, nitroglycerin, at least one plasticizer, at least one stibilizer, at least one burn moderator and, additionally, the said mixture of carbon black and cellulose acetate.

3. Double-base solid propellant as claimed in claim 1, wherein the carbon black content is from 0.05 to 1.0 wt.-% of the total weight of the solid propellant.

4. Double-base solid propellant as claimed in claim 1, additionally containing at least one other energy supplying high-energy substance.

5. Double-base solid propellant as claimed in claim 1, wherein the rate ratio of carbon black to cellulose acetate is from 1:2 to 1:5.

* * * * *